US005786059A

United States Patent [19]

Frank et al.

[11] Patent Number: 5,786,059

[45] Date of Patent: Jul. 28, 1998

[54] FIBER WEB/AEROGEL COMPOSITE MATERIAL COMPRISING BICOMPONENT FIBERS, PRODUCTION THEREOF AND USE THEREOF

[75] Inventors: Dierk Frank, Hofheim; Franz Thönnessen, Bobingen; Andreas Zimmermann, Griesheim, all of Germany

[73] Assignee: Hoechst Aktiengesellschaft, Frankfurt, Germany

[21] Appl. No.: 860,160

[22] PCT Filed: Dec. 21, 1995

[86] PCT No.: PCT/EP95/05083

§ 371 Date: Jun. 19, 1997

§ 102(e) Date: Jun. 19, 1997

[87] PCT Pub. No.: WO96/19607

PCT Pub. Date: Jun. 27, 1996

[30] Foreign Application Priority Data

Dec. 21, 1994 [DE] Germany ..... 44 45 771.5

[51] Int. Cl.[6] ..... B32B 1/04

[52] U.S. Cl. ..... 442/68; 428/75; 428/367; 428/373; 442/364; 442/365; 442/375

[58] Field of Search ..... 442/364, 365, 442/375; 428/68, 75, 367, 373

[56] References Cited

U.S. PATENT DOCUMENTS

| | | | |
|---|---|---|---|
| 4,808,202 | 2/1989 | Nishikawa et al. | 55/390 |
| 5,221,573 | 6/1993 | Baigas, Jr. | 156/62.6 |
| 5,256,476 | 10/1993 | Tanaka et al. | 428/241 |
| 5,271,780 | 12/1993 | Baigas, Jr. | 156/62.6 |

FOREIGN PATENT DOCUMENTS

| | | |
|---|---|---|
| 0269462A2 | 6/1988 | European Pat. Off. . |
| 3346180A1 | 8/1985 | Germany . |

*Primary Examiner*—James J. Bell
*Attorney, Agent, or Firm*—Frommer Lawrence & Haug LLP

[57] ABSTRACT

The disclosure is a composite material having at least one layer of fiber web and aerogel particles, wherein the fiber web comprises at least one bicomponent fiber material, the bicomponent fiber material having lower and higher melting regions and the fibers of the web being bonded not only to the aerogel particles but also to each other by the lower melting regions of the fiber material, a process for its production and its use.

14 Claims, No Drawings

FIBER WEB/AEROGEL COMPOSITE MATERIAL COMPRISING BICOMPONENT FIBERS, PRODUCTION THEREOF AND USE THEREOF

DESCRIPTION

The present invention relates to a composite material having at least one layer of fiber web and aerogel particles, to a process for its production and to its use.

Aerogels, especially those having porosities above 60% and densities below 0.4 g/cm$^3$, have a very low density, a high porosity and a low pore diameter and so an extremely low thermal conductivity and hence find application as thermal insulation materials, for example as described in EP-A-0 171 722.

However, the high porosity also leads to low mechanical stability not only of the gel from which the aerogel is dried but also of the dried aerogel itself.

Aerogels in the wider sense, i.e. in the sense of "gel having air as dispersion medium", are produced by drying a suitable gel. The term "aerogel" in this sense embraces aerogels in the narrower sense, xerogels and cryogels. A dried gel is an aerogel in the narrower sense when the liquid of the gel has been removed at temperatures above the critical temperature and starting from pressures above the critical pressure. If, by contrast, the liquid of the gel is removed subcritically, for example through formation of a liquid-vapor boundary phase, the resulting gel is termed a xerogel. It is to be noted that the gels of the invention are aerogels, in the sense of gel having air as dispersion medium.

The shaping of the aerogel is completed during the sol-gel transition. Once the solid gel structure has formed, the external shape can only be altered through comminution, for example grinding, the material being too brittle for any other form of processing.

However, there are many applications for which it is necessary to use the aerogels in the form of certain shaped structures. In principle, shaping is possible during gelling. However, the diffusion-governed exchange of solvents which is typically necessary during production (see, for example, U.S. Pat. No. 4,610,863, EP-A 0 396 076 re aerogels; see, for example, WO 93/06044 re aerogel composite materials) and the similarly diffusion-governed drying would lead to uneconomically long production times. It is therefore sensible to carry out any shaping after the formation of the aerogel, i.e. after drying, without any significant applications-dictated change taking place to the internal structure of the aerogel.

There are many applications, for example the insulation of curved or irregularly shaped surfaces, requiring flexible panels or mats composed of an insulant.

DE-A 33 46 180 describes bending-resistant panels composed of pressed structures based on pyrogenic silica aerogel in conjunction with a reinforcement in the form of long mineral fibers. However, the pyrogenic silica aerogel is not an aerogel within the above meaning, since it is not produced by drying a gel and hence has a completely different pore structure; it is therefore mechanically more stable and can therefore be pressed without destroying the microstructure, but it has a higher thermal conductivity than typical aerogels within the above meaning. The surface of such pressed structures is very sensitive and therefore has to be hardened, for example through the use of a binder at the surface or has to be protected by lamination with a film. Furthermore, the resulting pressed structure is not compressible.

Furthermore, German patent application P 44 18 843.9 describes a mat composed of a fiber-reinforced xerogel. These mats have very low thermal conductivity because of the very high aerogel content, but their production takes a relatively long time because of the above-described diffusion problems. More particularly, the production of thicker mats is only sensibly possible by combining a plurality of thin mats and hence necessitates additional expense.

It is an object of the present invention to provide a granular aerogel composite material which has low thermal conductivity, is mechanically stable and makes it simple to produce mats or panels.

This object is achieved by a composite material having at least one layer of fiber web and aerogel particles, wherein the fiber web comprises at least one bicomponent fiber material, the bicomponent fiber material having lower and higher melting regions and the fibers of the web being bonded not only to the aerogel particles but also to each other by the lower melting regions of the fiber material. The thermal consolidation of the bicomponent fibers leads to a bond between the low melting parts of the bicomponent fibers and hence ensures a stable web. At the same time, the lower melting part of the bicomponent fibers bonds the aerogel particles to the fiber.

The bicomponent fibers are manufactured fibers which are composed of two firmly interconnected polymers of different chemical and/or physical constructions and which have regions having different melting points, i.e. lower and higher melting regions. The melting points of the lower and higher melting regions preferably differ by at least 10° C. The bicomponent fibers preferably have a core-sheath structure. The core of the fiber is a polymer, preferably a thermoplastic polymer, whose melting point is higher than that of the thermoplastic polymer which forms the sheath. The bicomponent fibers are preferably polyester/copolyester bicomponent fibers. It is further possible to use bicomponent fiber variations composed of polyester/polyolefin, e.g. polyester/polyethylene, or polyester/copolyolefin or bicomponent fibers having an elastic sheath polymer. However, it is also possible to use side-by-side bicomponent fibers.

The fiber web may further comprise at least one simple fiber material which becomes bonded to the lower melting regions of the bicomponent fibers in the course of thermal consolidation.

The simple fibers are organic polymer fibers, for example polyester, polyolefin and/or polyamide fibers, preferably polyester fibers. The fibers can be round, trilobal, pentalobal, octalobal, ribbony, like a Christmas tree, dumbbell-shaped or otherwise star-shaped in cross section. It is similarly possible to use hollow fibers. The melting point of these simple fibers should be above that of the lower melting regions of the bicomponent fibers.

To reduce the radiative contribution to thermal conductivity, the bicomponent fibers, i.e. the high and/or low melting component, and optionally the simple fibers can be blackened with an IR opacifier such as, for example, carbon black, titanium dioxide, iron oxides or zirconium dioxide or mixtures thereof. For coloration, the bicomponent fibers and also optionally the simpler fibers can also be dyed.

The diameter of the fibers used in the composite should preferably be smaller than the average diameter of the aerogel particles to ensure the binding of a high proportion of aerogel in the fiber web. Very thin fiber diameters make it possible to produce mats which are very flexible, whereas thicker fibers, having greater bending stiffness, lead to bulkier and more rigid mats.

The linear density of the simple fibers should preferably be between 0.8 and 40 dtex, and the linear density of the bicomponent fibers should preferably be between 2 and 20 dtex.

It is also possible to use mixtures of bicomponent fibers and simple fibers composed of different materials, having different cross sections and/or different linear densities.

To ensure good consolidation of the web, on the one hand, and good adhesion of the aerogel granules, on the other, the weight proportion of bicomponent fiber should be between 10 and 100% by weight, preferably between 40 and 100% by weight, based on the total fiber content.

The volume proportion of the aerogel in the composite material should be as high as possible, at least 40%, preferably above 60%. However, to ensure that the composite has some mechanical stability, the proportion should not be above 95%, preferably not above 90%.

Suitable aerogels for the compositions of the invention are those based on metal oxides which are suitable for the sol-gel technique (C. J. Brinker, G. W. Scherer, Sol-Gel-Science, 1990 chapters 2 and 3), such as, for example, silicon or aluminum compounds or those based on organic substances which are suitable for the sol-gel technique, such as melamine-formaldehyde condensates (U.S. Pat. No. 5,086,085) or resorcinol-formaldehyde condensates (U.S. Pat. No. 4,873,218). They can also be based on mixtures of the abovementioned materials. Preference is given to using aerogels comprising silicon compounds, especially $SiO_2$ aerogels, very particularly preferably $SiO_2$ xerogels. To reduce the radiative contribution to thermal conductivity, the aerogel may comprise IR opacifier such as, for example, carbon black, titanium dioxide, iron oxides, zirconium dioxide or mixtures thereof.

In addition, the thermal conductivity of aerogels decreases with increasing porosity and decreasing density. This is why aerogels having porosities above 60% and densities below 0.4 g/cm$^3$ are preferred. The thermal conductivity of the aerogel granules should be less than 40 mW/mK, preferably less than 25 mW/mK.

In a preferred embodiment, the aerogel particles have hydrophobic surface groups. This is because—if a later collapse of the aerogels due to condensation of moisture in the pores is to be avoided—it is advantageous for the inner surface of the aerogels to be equipped with covalently held hydrophobic groups which will not become detached under the action of water. Preferred groups for durable hydrophobicization are trisubstituted silyl groups of the general formula —$Si(R)_3$, particularly preferably trialkyl- and/or triaryl-silyl groups, where each R is independently of the others a nonreactive, organic radical such as $C_1$-$C_{18}$-alkyl or $C_6$-$C_{14}$-aryl, preferably $C_1$-$C_6$-alkyl or phenyl, especially methyl, ethyl, cyclohexyl or phenyl, which may be additionally substituted by functional groups. Trimethylsilyl groups are particularly advantageous to obtain durable hydrophobicization of the aerogel. These groups can be introduced as described in WO 94/25149 or by gas phase reaction between the aerogel and, for example, an activated trialkylsilane derivative, such as, for example, a chlorotrialkylsilane or a hexaalkyldisilazane (compare R. Iler, The Chemistry of Silica, Wiley & Sons, 1979).

The size of the grains depends on the application of the material. However, to bind a high proportion of aerogel granules, the particles should be greater than the fiber diameter, preferably greater than 30 μm. To obtain high stability, the granules should not be coarse; the granules should preferably be less than 2 cm.

To achieve high aerogel volume proportions, it is preferably possible to use granules having a bimodal particle size distribution. Other suitable distributions can be used as well.

The fire class of the composite is determined by the fire class of the aerogel and of the fibers. To obtain an optimum fire class for the composite, low-flammability fiber types should be used, for example Trevira CS®.

If the composite material consists exclusively of the fiber web which comprises the aerogel particles, mechanical stress on the composite material can cause aerogel granules to break or to become detached from the fiber, so that fragments may fall out of the web.

For certain applications, it is therefore advantageous for the fiber web to be provided on one or both sides with at least one cover layer in each case, the cover layers being identical or different. The cover layers can be adhered either in the course of the thermal consolidation via the low melting component of the bicomponent fiber or by means of some other adhesive. The cover layer can be for example a plastics film, preferably a metal foil or a metallized plastics film. Furthermore, each cover layer can itself consist of a plurality of layers.

Preference is given to a fiber web/aerogel composite material in the form of mats or panels which has an aerogel-comprising fiber web as middle layer and on both sides a cover layer each, at least one of the cover layers comprising web layers composed of a mixture of fine, simple fibers and fine bicomponent fibers, and the individual fiber layers being thermally consolidated within and between themselves.

The choice of bicomponent fibers and of simple fibers for the cover layer is subject to the same remarks as the choice of fibers for the fiber web holding the aerogel particles. To obtain a highly impenetrable cover layer, however, both the simple fibers and the bicomponent fibers should have diameters less than 30 μm, preferably less than 15 μm.

To obtain greater stability or impenetrability for the surface layers, the web layers of the cover layers can be needled.

It is a further object of the present invention to provide a process for producing the composite material of the invention.

The composite material of the invention can be produced for example by the following process:

To produce the fiber web, staple fibers are used in the form of commercially available flat or roller cards. While the web is laid according to the processes familiar to the person skilled in the art, the granular aerogel is sprinkled in. Incorporation of the aerogel granules into the fiber assembly should be very uniform. Commercially available sprinklers ensure this.

When cover layers are used, the fiber web can be laid onto one cover layer while the aerogel is sprinkled in and, after completion of this operation, the top cover layer is applied.

If cover layers composed of a finer fiber material are used, initially the lower web layer is laid from fine fibers and/or bicomponent fibers, and optionally needled, according to known processes. The aerogel-comprising fiber assembly is applied on top as described above. For a further, upper cover layer, it is possible to proceed as for the lower web layer and on fine fibers and/or bicomponent fibers to lay a layer and optionally needle it.

The resulting fiber composite is thermally consolidated at temperatures between the melting temperature of the sheath material and the lower of the melting temperatures of simple fiber material and high melting component of the bicomponent fiber, with or without employment of pressure. The pressure is between atmospheric pressure and the compressive strength of the aerogel used.

The entire processing operations can preferably be carried out continuously on equipment known to the person skilled in the art.

The panels and mats of the invention are useful as thermal insulation materials because of their low thermal conductivity.

In addition, the panels and mats of the invention can be used as acoustic absorption materials directly or in the form of resonance absorbers, since they have a low sound velocity and, compared with monolithic aerogels, a higher sound damping capacity. This is because, in addition to the damping provided by the aerogel material, additional damping occurs due to air friction between the pores in the web material, depending on the permeability of the fiber web. The permeability of the fiber web can be varied by varying the fiber diameter, the web density and the size of the aerogel particles. If the web comprises additional cover layers, these cover layers should permit ingress of the sound into the web and not lead to a substantial reflection of the sound.

The panels and mats of the invention are also useful as adsorption materials for liquids, vapors and gases because of the porosity of the web and especially the high porosity and specific surface area of the aerogel. Specific adsorption can be achieved through modification of the aerogel surface.

The invention will now be more particularly described by way of example.

EXAMPLE 1

50% by weight of Trevira 290, 0.8 dtex/38 mm hm and 50% by weight of PES/co-PES bicomponent fibers of the type Trevira 254, 2.2 dtex/50 mm hm were used to lay a fiber web having a basis weight of 100 g/m$^2$. During laying, a granular hydrophobic aerogel based on TEOS and having a density of 150 kg/m$^3$ and a thermal conductivity of 23 mW/mK and also particle sizes 1 to 2 mm in diameter was sprinkled in.

The resulting web composite material was thermally consolidated at 160° C. for 5 minutes and compressed to a thickness of 1.4 cm.

The volume proportion of the aerogel in the consolidated mat was 51%. The resulting mat had a basis weight of 1.2 kg/m$^2$. It was readily bendable and also compressible. Its thermal conductivity was found to be 28 mW/mK, measured by a plate method conforming to DIN 52 612 Part 1.

EXAMPLE 2

50% by weight of Trevira 120 staple fibers having a linear density of 1.7 dtex, length 38 mm, spun-dyed black and 50% by weight of PES/co-PES bicomponent fibers of the type Trevira 254, 2.2 dtex/50 mm hm were used to lay initially a web which served as lower cover layer. This cover layer had a basis weight of 100 g/m$^2$. On top, as middle layer, a fiber web was laid with a basis weight of 100 g/m$^2$ from 50% by weight of Trevira 292, 40 dtex/60 mm hm and 50% by weight of PES/co-PES bicomponent fibers of the type Trevira 254, 4.4 dtex/50 mm hm. During laying, a granular hydrophobic aerogel based on TEOS and having a density of 150 kg/m$^3$ and a thermal conductivity of 23 mW/mK and also particle sizes 2 to 4 mm in diameter was sprinkled in. This aerogel-comprising fiber web was covered with a cover layer constructed in the same way as the lower cover layer.

The resulting composite material was thermally consolidated at 160° C. for 5 minutes and compressed to a thickness of 1.5 cm. The volume proportion of the aerogel in the consolidated mat was 51%.

The resulting mat had a basis weight of 1.4 kg/m$^2$. Its thermal conductivity was found to be 27 mW/mK, measured by a plate method conforming to DIN 52612 Part 1.

The mat was readily bendable and compressible. The mat did not shed any aerogel granules even after bending.

What is claimed is:

1. A composite material having at least one layer of fiber web and aerogel particles, wherein the fiber web comprises at least one bicomponent fiber material, the bicomponent fiber material having lower and higher melting regions and the fibers of the web being bonded not only to the aerogel particles but also to each other by the lower melting regions of the fiber material.

2. The composite material of claim 1, wherein the bicomponent fiber material has a core-sheath structure.

3. The composite material of claim 1, wherein the fiber web further comprises at least one simple fiber material.

4. The composite material of at least one of claims 1 to 3, wherein the linear density of the bicomponent fiber material is within the range from 2 to 20 dtex and the linear density of the simple fibers is within the range from 0.8 to 40 dtex.

5. The composite material of claim 1, wherein the proportion of aerogel particles in the composite material is at least 40% by volume.

6. The composite material of claim 1, wherein the aerogel is an $SiO_2$ aerogel.

7. The composite material of claim 1, wherein the bicomponent fiber material, the simple fiber material and/or the aerogel particles comprise at least one IR opacifier.

8. The composite material of claim 1, wherein the aerogel particles have porosities above 60%, densities below 0.4 g/cm$^3$ and a thermal conductivity of less than 40 mW/mK, preferably less than 25 mW/mK.

9. The composite material of claim 1, wherein the aerogel particles have hydrophobic surface groups.

10. The composite material of claim 1, wherein the fiber web is provided on one or both sides with at least one cover layer in each case, the cover layers being identical or different.

11. The composite material of claim 10, wherein the cover layers comprise plastics films, metal foils, metallized plastics films or preferably web layers composed of fine simple fibers and/or fine bicomponent fibers.

12. The composite material of claim 1 in the form of a panel or mat.

13. A process for producing a composite material as claimed in claim 1, which comprises sprinkling the aerogel particles into a fiber web comprising at least one bicomponent fiber material having lower and higher melting regions and thermally consolidating the resulting fiber composite at temperatures above the lower melting temperature and below the higher melting temperature with or without employment of pressure.

14. The use of a composite material as claimed in claim 1 for thermal insulation, acoustic insulation and/or as adsorption material for gases, vapors and liquids.

* * * * *